United States Patent [19]

Rio

[11] 4,273,311

[45] Jun. 16, 1981

[54] RESCUE TOOL HAVING SPREADER PLATES

[75] Inventor: Gerald J. Rio, Hebron, Conn.

[73] Assignee: Cranjer Company, Inc., Amston, Conn.

[21] Appl. No.: 110,764

[22] Filed: Jan. 9, 1980

[51] Int. Cl.[3] ..... B66F 3/00

[52] U.S. Cl. ..... 254/93 R; 72/705; 254/124; 254/133 R

[58] Field of Search ..... 72/392, 705, 481; 269/279, 280, 283, 75; 254/133, 124, 126, 93 R; 81/180 B

[56] References Cited

U.S. PATENT DOCUMENTS

| | | | |
|---|---|---|---|
| 1,916,476 | 7/1933 | Harbaugh et al. | 254/133 R |
| 2,560,797 | 7/1951 | Humphreys | 254/126 |
| 2,585,158 | 2/1952 | Morgenthaler | 254/126 X |
| 2,588,509 | 3/1952 | Forster | 254/133 R X |
| 3,317,188 | 5/1967 | Linscott et al. | 254/133 R |
| 3,762,688 | 10/1973 | Leonhardt | 254/133 |
| 3,819,153 | 6/1974 | Hurst et al. | 254/93 R |

*Primary Examiner*—Robert C. Watson
*Attorney, Agent, or Firm*—McCormick, Paulding & Huber

[57] ABSTRACT

A portable hydraulically operated rescue tool has a pair of force arms supported for pivotal movement adjacent inner ends and an hydraulic piston-cylinder assembly for pivoting the arms to move the outer end portions of the arms generally toward and away from each other between adjacent and spread apart positions. Spreader plate assemblies are releasably connected to the outer ends of the force arms. Each plate assembly includes a spreader plate connected to an associated force arm to pivot about an axis which extends transversely of the longitudinal axis of the arm and which is spaced longitudinally inwardly from the outer end of the arm. Each plate may be further supported to swivel about a central axis normal to its pivotal axis. One of the plates may have an arcuately concave contour for gripping engagement with a cylindrical member, such as the steering column of a motor vehicle.

12 Claims, 12 Drawing Figures

RESCUE TOOL HAVING SPREADER PLATES

BACKGROUND OF THE INVENTION

This invention relates in general to portable rescue tools and deals more particularly with an improved power operated rescue tool of the type used to extricate accident victims trapped in wreckage of motor vehicles, aircraft and the like. A typical tool of the aforedescribed general type is illustrated and described in U.S. Pat. No. 3,819,153 to Hurst for RESCUE TOOL, issued June 25, 1974. Such rescue tools have gained general acceptance and are in wide spread use by fire departments, police departments, paramedic units and others engaged in emergency rescue work. When rendering such life saving assistance it is important to work quickly to remove an accident victim from the wreckage so that necessary emergency medical treatment may be provided as promptly as possible. In many instances where a rescue tool of the aforedescribed type is used to spread wreckage, the tool may interfere with the removal of the accident victim unless it is removed after the wreckage has been opened. Where such condition is encountered, precious life saving time may be lost in dismantling the tool. Such a condition may be encountered, for example, where a rescue tool is used to spread the damaged window frame of a wrecked automobile so that an injured person can be removed through the window opening. Further, the tips of such a rescue tool are generally relatively small being designed to facilitate insertion into a narrow space between damaged parts to be pried or spread apart. The small tips exert extremely high pressure and may tend to cut into or further deform the damaged parts to be separated before effecting any appreciable movement of the parts. It may be necessary to reposition the tool several times to attain sufficient purchase to effect spreading of the parts. The aforedescribed condition is often encountered when moving a seat in a damaged motor vehicle, since the seat material lacks the necessary integrity to resist a concentrated applied force and has relatively small frame surface areas against which the reactive force of the tool may be applied. A similar problem may be encountered in raising the collapsed dashboard of a wrecked motor vehicle. The force arms of the tool must generally apply opposing force between the floor of the vehicle, which is made from relatively thin sheet metal, and the dashboard, which may be made from plastic or other light material easily penetrated by application of high force concentrated in a relatively small area. Still another problem may be encountered in raising the collapsed steering column of a motor vehicle due to difficulty in positioning the rescue tool so that the tip of one of the force arms grippingly engages the steering column without sliding. All of the aforedescribed problems add appreciably to the time required to effect rescue. The present invention is concerned with these problems.

SUMMARY OF THE INVENTION

In accordance with the present invention an improved rescue tool of the type which includes a pair of force arms pivotally supported at inner ends and power means for moving the outer ends of the arms toward and away from each other between adjacent or retracted and spread apart positions has at least one spreader plate assembly mounted at the outer end of an associated one of the force arms. The latter assembly includes a spreader plate supported for pivotal movement about an axis extending transversely of the longitudinal axis of the arm and spaced longitudinally inwardly from the outer end of the arm. When the tool is provided with two such plate assemblies each spreader plate may be arranged to swivel about another axis which is generally normal to its pivotal axis. A spreader plate such as aforedescribed may have a concave contour for gripping engagement with an associated cylindrical member, such as the steering column of a motor vehicle.

DETAILED DESCRIPTION OF PREFERRED EMBODIMENTS

Figure 1:
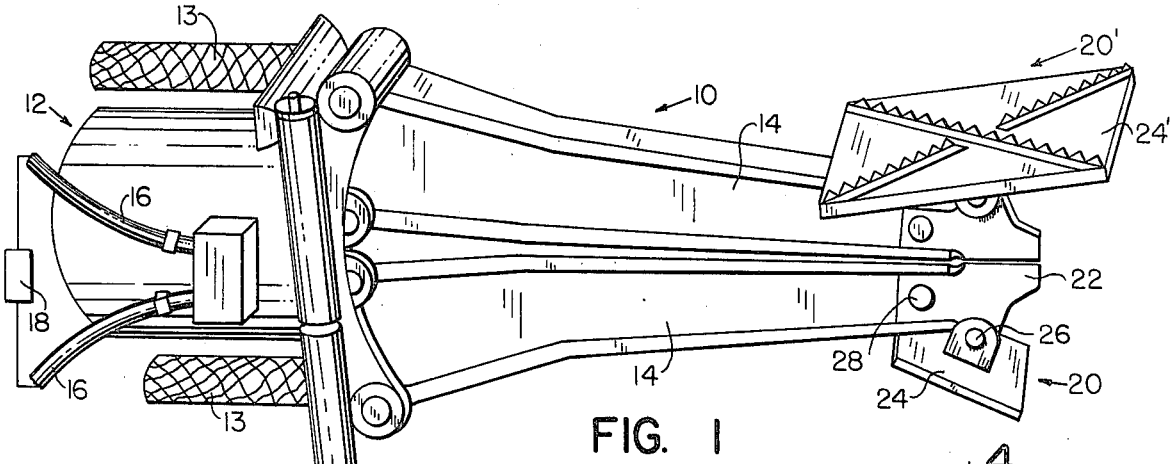
FIG. 1 is a perspective view of a rescue tool embodying the present invention.

Turning now to the drawings, an improved rescue tool embodying the present invention is shown in FIG. 1 and indicated generally by the reference numeral 10. The tool 10 is a portable hydraulically operated device capable of applying pushing forces of high magnitude and particularly adapted for such prying and jacking operations as may be required to extricate a trapped accident victim from a damaged motor vehicle, aircraft, or the like. It has a main body assembly, indicated generally at 12, which includes as hydraulic piston-cylinder assembly, a pair of handles 13, 13 for manually positioning the tool, and a pair of movable force arms 14, 14 supported on the body. Each force arm 14 is pivotally connected at its inner end to the body assembly 12. A pair of flexible conduits or hoses 16, 16 communicate with the hydraulic cylinder and are connected to suitable source of pressure fluid such as an hydraulic pump, schematically illustrated and indicated by the numeral 18, for supplying fluid under pressure to the hydraulic cylinder to drive the piston. The piston is connected to the arms 14, 14 by a piston rod and linkage (not shown) and is arranged to pivot the force arms to move the outer ends of the arms toward and away from each other between retracted and spread apart positions.

Rescue tools, such as the tool 10 hereinbefore generally described are well known in the art. However, for a more complete disclosure of such a tool reference may be had to the aforementioned U.S. Pat. No. 3,819,153, to Hurst, which is hereby adopted by reference as a part of the present disclosure.

Figure 4:
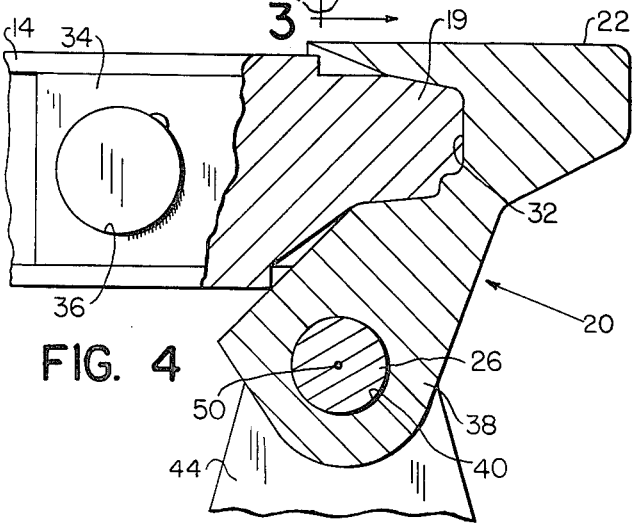
FIG. 4 is a fragmentary sectional view taken along the line 4—4 of FIG. 3.
Figure 6:
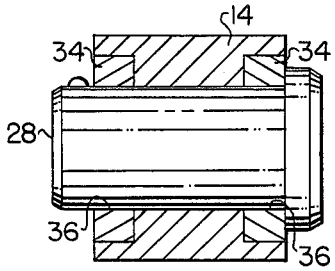
FIG. 6 is a sectional view taken along the line 6—6 of FIG. 2.

Each force arm 14 includes an outer end portion or tip indicated at 19 in FIG. 4 which has a generally rectangular cross section. Inwardly of its tip, the arm 14 has a generally I-shaped cross section characterized by a vertically disposed web portion and upper and lower flanges, as best shown in FIG. 6. In accordance with the present invention, a spreader plate assembly is releasably connected to at least one of the force arms 14, 14, but preferably, and as shown, each of the force arms carries an associated spreader plate assembly. In FIG. 1 the spreader plate assemblies are designated generally by the numerals 20, 20'.

Considering now the spreader plate assembly 20 in further detail and referring particularly to FIGS. 2–6, the illustrated plate assembly includes a support member or body 22, a spreader plate 24, a pivot pin 26, which connects the spreader plate to the support member 22, and a retaining pin 28 which releasably secures the body to an associate force arm 14.

Figure 2:
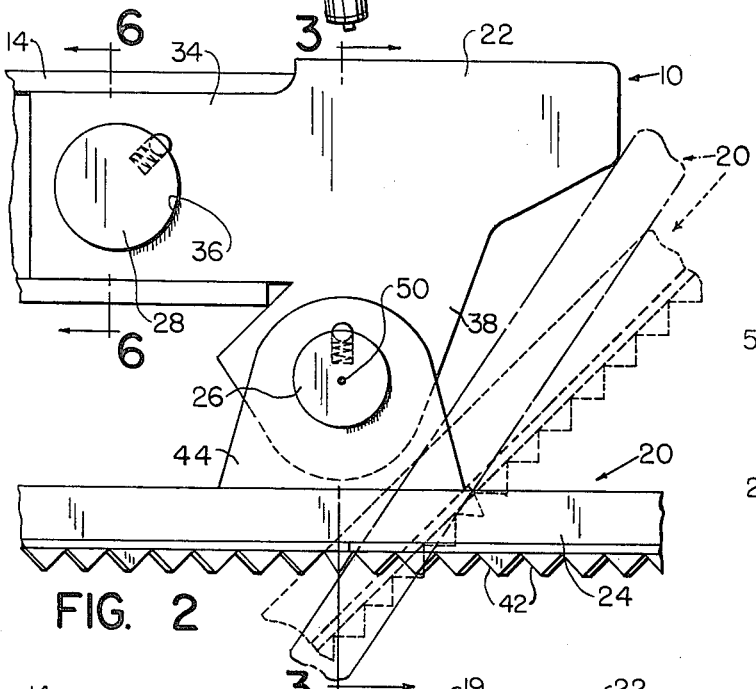
FIG. 2 is a somewhat enlarged fragmentary elevational view of a portion of the tool of FIG. 1 and shows a spreader plate assembly.

The support member 22 preferably comprises a metal weldment and has a longitudinally inwardly opening cavity 32 which receives and substantially complements the tip 19 of an associated force arm 14 as shown in FIG. 4. Integral laterally spaced apart side portions 34, 34 extend longitudinally inwardly from the support member 22 inwardly of the cavity 32 and in the direction of the tool body assembly 12. The side portions 34, 34 are disposed generally adjacent opposite sides of the central web of the associated arm 14 and between its upper and lower flanges, substantially as shown in FIG. 6. The side portions 34, 34 have cylindrical apertures 36, 36 therethrough laterally aligned with an associated aperture in the arm 14 and receive the retaining pin 28 when the support member is mounted on the arm 14, as best shown in FIGS. 2, 4 and 6. A transversely outwardly extending integral boss 38, spaced longitudinally inwardly from the free end or tip of the support member, has a cylindrical aperture 40 which receives the pivot pin 26.

Figure 3:
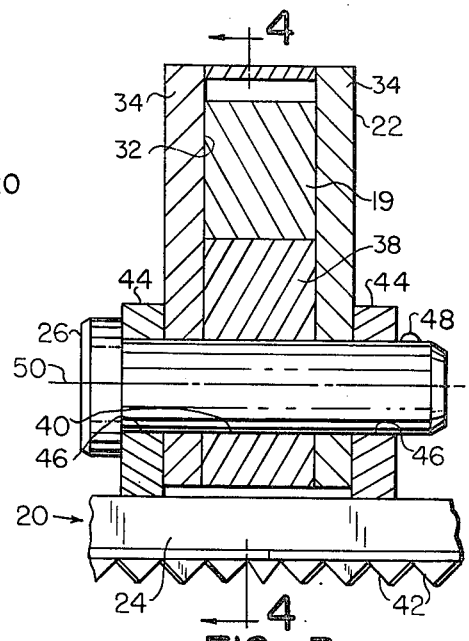
FIG. 3 is a front elevational view of the tool shown partially in section.
Figure 5:
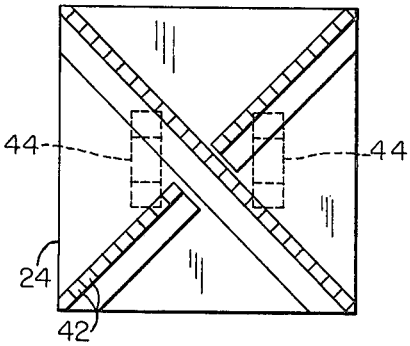
FIG. 5 is a somewhat reduced bottom view of the spreader plate shown in FIG. 4.

The spreader plates may take various forms, however, the illustrated plate 24 is generally rectangular and has a gripping surface formed by serrations or teeth 42, 42. As shown, the teeth 42, 42 are ground on the legs of angle irons which are welded or otherwise secured to one surface of the plate 26 and extend diagonally thereof, as best shown in FIG. 5. A pair of ears 44, 44, welded or otherwise secured to the opposite surface of the plate 26 in laterally spaced apart relation, receive the boss 38 therebetween to form a clevis. Laterally aligned cylindrical apertures 46, 46 formed in the ears 44, 44 align with the aperture 40 to receive the pivot pin 28 whereby the plate 26 is pivotally secured to the support member 22. The pivot pin 26 is preferably a quick release type headed at one end and provided with a spring ball detend 48 at its opposite end, as best shown in FIG. 3.

The plate 26 is mounted on the support member 22 to pivot about an axis 50 which extends laterally relative to the longitudinal axis of the associated force arm 14 and which is spaced inwardly from the outer end of the tip 19. Thus, the tip portion 19 acts through the support member 22 to apply force to the plate 26 in a transverse direction relative to its associated force arm 14 when the arms 14, 14 are moved away from each other and toward a transversely spread position by operation of the hydraulic pump 18.

The tip or outer end of the support member 22 extends for some distance outwardly beyond the pivot axis 50 and forms an abutment stop to limit angular movement of the plate 20, as shown in broken lines in FIG. 2, thereby maintaining the plate in a general operative position.

When the tool 10 is used to raise the collapsed dashboard of a damaged motor vehicle, for example, it is positioned with one of its spreader plates in engagement with the vehicle floor and the other of its plates engaged with an associated portion of the dashboard. The teeth 42, 42 positively grippingly engage the floor and dashboard so that the tool will not slip when hydraulic pressure is applied to the piston cylinder assembly by the pump 18 whereby to spread the plates. The relatively large surface area of the plate which engages the dashboard prevents cutting into the dashboard and lifts the relatively large portion of the dashboard so that the spreading operation may generally be completed in full cycle of the tool, that is in moving the plates from retracted to a desired spread apart condition.

In using the tool to move the seat of a damaged motor vehicle it is usually necessary to remove or at least open the door of the vehicle nearest the portion of the seat to be moved. The larger of the two spreader plates, that is the illustrated plate 20', is preferably placed against the lower part of the seat to engage the seat frame. The force arms 14, 14 are spread to engage the smaller of the plates, that is the plate 20, with an associated portion of the door frame. If the plates are properly positioned with respect to the seat and the door frame, a single cycle of the tool should be sufficient to move the seat a substantial distance in a direction away from the door frame.

If the space into which the ends of the tool 10 must be inserted is not large enough to accommodate the plates 20, 20' the plates may be quickly removed from the tool by pulling out the quick connect pins 26, 26. The support members 22, 22 may then be used as prying jaws to increase the space between the parts to be separated whereby to accommodate the spreader plate assemblies 20, 20'. Thereafter, the spreader plate assemblies are reattached to the tool and the spreading operation resumed.

Figure 7:
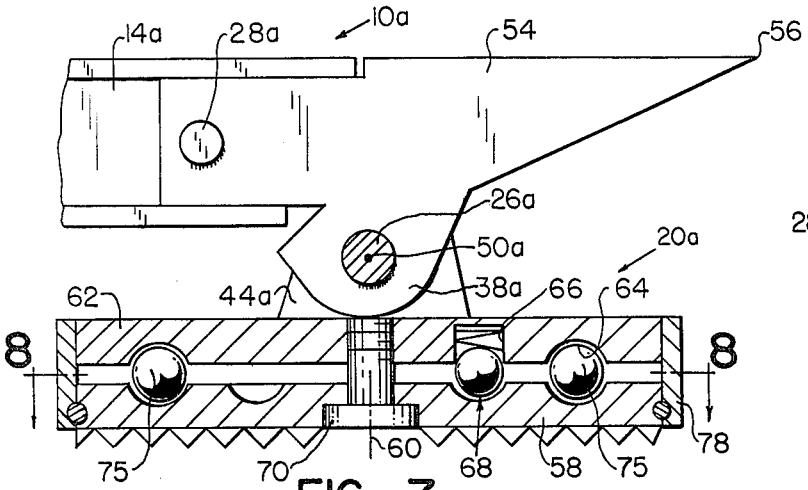
FIG. 7 is a fragmentary side elevational view similar to FIG. 2, shown partially in section, which illustrates another embodiment of the invention.
Figure 8:
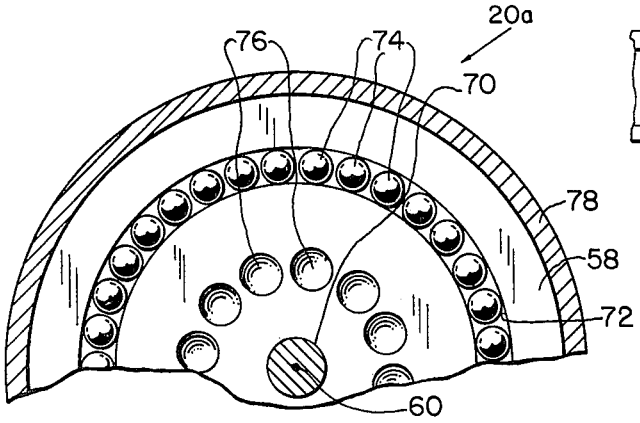
FIG. 8 is a fragmentary sectional view taken along the line 8—8 of FIG. 7.
Figure 9:
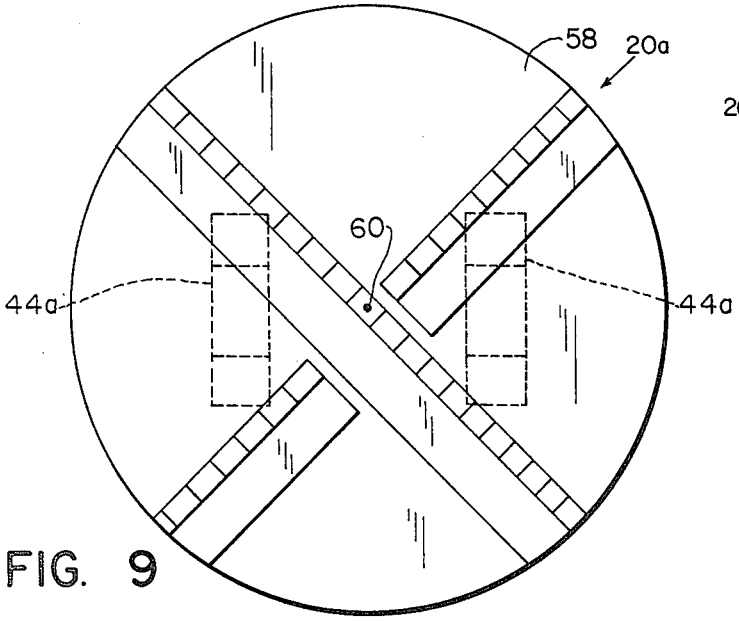
FIG. 9 is a bottom view of the spreader plate shown in FIGS. 7 and 8.

Referring now to FIGS. 7–9, another tool embodying the invention is shown and indicated generally by the reference numeral **10*a*. Parts of the tool 10*a* which are substantially identical to parts of the tool 10**, previously described, bear the same reference numerals as the previously described parts and a letter "a" suffix and will not be hereinafter discussed in detail.

The tool **10*a* is similar in many respects to the tool 10 and includes a pair of pivoted force arms 14*a*, 14*a* (one shown). A pair of spreader plate assemblies, which are or may be substantially identical to each other, are releasably connected to the outer ends of the force arms 14*a*, 14*a* by quick-connect retaining pins, in the manner generally aforedescribed. A typical spreader plate assembly indicated generally at 20*a* and shown in FIGS. 7–9 is connected to an associated arm 14*a* by a retaining pin 28*a*. A support member 54 is similar in most respects to the support member 22 previously described, but differs therefrom in the shape of its outer end. Specifically, the free end of the support member 54 is defined by a pair of converging surfaces which terminate along a line of intersection indicated at 56** forming a sharp edge.

The spreader plate assembly 20*a* includes a spreader plate 58 supported to pivot about an axis 50*a* which extends laterally of the longitudinal axis of the arm 14*a*. The spreader plate 58 is further supported to swivel about another axis 60 which is normal to and intersects the axis 50*a*. As shown, the spreader plate 58 is generally circular and supported by a back plate 62 which is also circular and of substantially the same diameter. The back plate 62 has a pair of spaced apart ears 44*a*, 44*a* (one shown) which cooperate with the boss 38*a* to receive a pivot pin 26*a*. A coaxial annular groove 64 opens through the lower surface of the back plate 62 and has a parti-circular cross section, as best shown in FIG. 7. A blind cylindrical recess 66 opens through the lower surface of the plate 62 to receive a spring ball detent indicated generally at 68 in FIG. 7.

The spreader plate 58 is secured to the back plate 62 for rotation about the axis 60 by a stud 70 which passes through a central aperture in the spreader plate 58 and threadably engages the back plate, substantially as shown in FIG. 7. A coaxial annular groove 72 of parti-circular cross section opens through the upper surface of the spreader plate 58 and cooperates with the groove 64 to form a race for receiving a plurality of ball bearings 74, 74 as shown in FIG. 7. A coaxial series of parti-spherical recesses or ball receiving pockets 76, 76 open through the upper surface of the spreader plate 58 to receive the ball associated with the spring detent mechanism 68. An annular skirt 78 secured to the plate 62 depends therefrom and generally surrounds the peripheral edge of the spreader plate 58. A seal is formed by an O-ring 76 received within opposing annular grooves formed in the skirt 78 and the peripheral edge of the spreader plate 58 to prevent dirt or other foreign material from entering the space between the plates 58 and 62 and ball bearing race defined by the plates. The spreader plate 58 has a gripping surface formed by toothed angle members welded or otherwise secured to the lower surface of the spreader plate and extending diametrically thereacross.

The tool 10*a* may be used for any of the spreading operations hereinbefore described with reference to the tool 10, however, the tool 10*a* may be swivelled about the axes 60, 60 of its spreader plates while the spreader plates are engaged in working or spreading condition. When the tool 10*a* is used to spread the damaged frame of an automobile window, for example, to increase the size of the window opening so that an accident victim may be lifted through the opening, the spreader plates of the tool are disposed in spreading engagement with opposite sides of the window frame. After the window frame has been spread, the tool body assembly 12*a* and force arms 14*a*, 14*a* may be swivelled angularly about the spreader plate axes 60, 60 and to an out-of-the-way position while the spreader plates are in spreading engagement with the window frame, so that the presence of the tool does not interfere with removal of the injured person. Then, if it is found that additional clearance is required to effect safe removal of the accident victim, the tool may be swivelled back to a convenient working position whereby the spreading operation may be resumed. Thus, valuable life saving time is saved which might otherwise be lost in removing the tool from engagement with the window frame after the initial spreading operation and repositioning it relative to the frame to facilitate further spreading of the frame.

Figure 10:
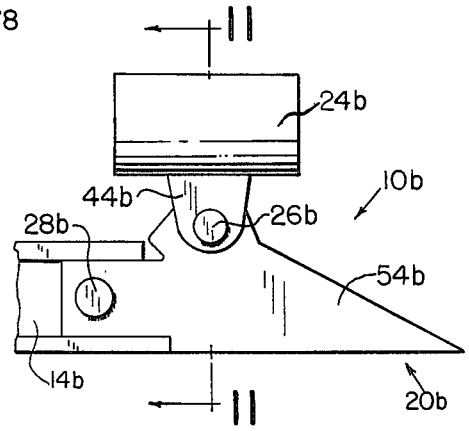
FIG. 10 is a somewhat reduced side elevational view similar to FIG. 2, and shows still another embodiment of the invention.
Figure 11:
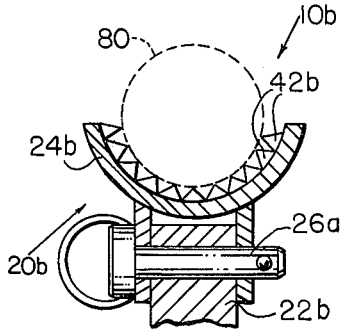
FIG. 11 is a sectional view taken along the line 11—11 of FIG. 10.

In FIGS. 10 and 11 there is shown still another embodiment of the invention, particularly adapted for raising a collapsed steering column of a motor vehicle, for example. The tool, indicated generally by the numeral 10*b*, has a spreader plate assembly 20*b* mounted thereon which includes a support member 54*b*, similar in all respects to the support member 54 previously described. A retaining pin 28*b* serves to releasably retain the support member 54*b* in connected relation with an associated force arm 14*b* which comprises a part of the tool 10*b*. The tool 10*b* includes a spreader plate 24*b* which is pivotally supported on the support member 54*b* by a clevis formed by a pivot pin 26*b* and associated ears 44*b*, 44*b*. The plate 24*b* is generally rectangular and formed with a convex arcuate contour as best shown in FIG. 11 to substantially complement an associated portion of a cylindrical part, such as the steering column of a motor vehicle shown in phantom in FIG. 11 and designated by the numeral 80. The arcuate plate 24*b* has a gripping surface formed by a plurality of teeth 42*b*, 42*b*. The other force arm of the tool 10*b* is preferably carries a substantially planar spreader plate, such as the spreader plate 20 shown in FIG. 1.

When the tool 10*b* is used to raise a collapsed steering column of a motor vehicle, for example, the planar support plate is preferably positioned in engagement with the floor of the vehicle whereas the arcuately contoured plate 24*b* is engaged with an associated portion of the collapsed steering column. Thereafter, the application of a spreading or jacking force to the tool, by operation of an associated hydraulic pump, as aforedescribed, should be sufficient to raise the column in a single cycle of tool operation. The gripping surface on the plate 24*b* assures non-slip engagement with the steering column whereby the column may be raised or moved laterally, as required, to attain a desired clearance between the column and another part of the vehicle.

Figure 12:
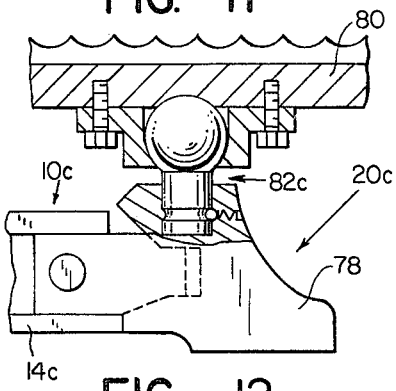
FIG. 12 is similar to FIG. 10 and shows a still further embodiment of the invention.

Still another spreader plate assembly embodying the invention and indicated generally at 20*c* is shown in FIG. 12 mounted on a force arm of another tool 10*c*. The assembly 20*c* includes a support member 78 which is mounted on the force arm 14*c* in the manner generally aforedescribed. The assembly further includes a spreader plate 80 which is connected to the support member 78 by a universal joint or ball and socket joint indicated generally at 82 to pivot about a center which is spaced laterally of and generally longitudinally inwardly from the outer end of the arm 14*c*. The tool 10*c* may be provided with one or two spreader plate assemblies such as the assembly 20*c*. The tool 10*c* may be used most advantageously to spread parts which have surfaces skewed relative to each other.

I claim:

1. In a portable fluid operated rescue tool having a body assembly including a pair of elongated force arms pivotally supported at the inner ends thereof on the body assembly for movement between retracted and spread positions, the arms being generally adjacent to each other in the retracted position and the outer ends of the arms being in spread apart relation to each other in the spread position, and fluid operated power means for moving the arms between the retracted and spread positions, the improvement comprising at least one spreader plate assembly including a support member having an inwardly opening cavity receiving an associated outer end portion of one of said arms therein and substantially complementing said associated outer end portion, means for releasably retaining said support member in connected engagement with said one arm, a spreader plate member, and means supporting said spreader plate member on said support member to pivot about a first axis extending in a transverse direction relative to the longitudinal axis of said one arm and for swivelling movement about a second axis generally normal to said first axis and including another plate, means connecting said spreader plate member to said other plate to swivel relative thereto about said second axis, and means connecting said other plate to said support member for pivotal movement about said first axis, said first axis being spaced longitudinally inwardly from the outer end of said one arm.

2. In a portable fluid operated rescue tool as set forth in claim 1 including means for releasably retaining said spreader plate member in any one of a plurality of angular positions about said second axis and relative to said force arms.

3. In a portable fluid operated rescue tool as set forth in claim 1 the further improvement wherein said spreader plate member and said other plate cooperate to define a bearing race therebetween and said supporting means comprises a plurality of bearing members disposed within said bearing race.

4. In a portable fluid operated rescue tool as set forth in claim 3 the further improvement including means for releasably retaining said spreader plate member in any one of a plurality of angular positions about said second axis and relative to said other plate.

5. A spreader plate assembly for a portable fluid operated rescue tool having a body assembly including a pair of elongated force arms pivotally supported at the inner ends thereof on the body assembly for movement between retracted and spread positions, the arms being generally adjacent to each other in the retracted position and the outer ends of the arms being in spread apart relation to each other in the spread position, and fluid operated power means for moving the arms between the retracted and spread positions, said spreader plate assembly comprising a support member having a cavity opening through its inner end for receiving the outer end portion of an associated one of the arms therein and substantially complementing the associated outer end portion, means for releasably retaining said support member in connected engagement with the associated arm, a spreader plate, and means supporting said spreader plate on said support member to pivot about a first axis extending in a transverse direction relative to said support member and for swivelling movement about a second axis generally normal to said first axis and including another plate, means connecting said spreader plate to said other plate to swivel relative thereto about said second axis and, means connecting said other plate to said support member for pivotal movement about said first axis, said first axis being spaced inwardly from the outer end of said support member.

6. In a portable fluid operated rescue tool having a body assembly including a pair of longitudinally elongated force arms pivotally supported at the inner ends thereof on the body assembly for movement between retracted and spread positions, the arms being generally adjacent to each other in the retracted position and the outer ends of the arms being in transversely spread apart relation to each other in the spread position, and fluid operated power means for moving the arms between the retracted and spread positions, the improvement comprising at least one spreader plate assembly including a support member having a body portion defining a longitudinally inwardly opening cavity receiving an associated outer end portion of one of the arms therein and shaped to substantially complement said associated outer end portion, means for releasably retaining said support member in connected engagement with said one arm with said outer end portion received in complementary engagement with said support member within said cavity and including a pair of laterally spaced apart side portions integrally connected to said body portion and extending longitudinally inwardly adjacent opposite sides of said one arm and a pin extending through said side portions and said one arm, said body portion having a transversely outwardly extending integral boss thereon spaced longitudinally inwardly from the outer end of said cavity, a spreader plate having a transversely outwardly facing surface and a pair of laterally spaced apart transversely inwardly extending ears receiving said mounting boss therebetween, and a pivot pin extending through said ears and said mounting boss and supporting said spreader plate for pivotal movement about an axis extending in a lateral direction and spaced transversely outwardly beyond said cavity and longitudinally inwardly beyond the outer end of said cavity.

7. In a portable operated fluid powered rescue tool as set forth in claim 6 the further improvement wherein the outer end portion of said support member is defined by a pair of surfaces converging towards said outer end.

8. In a portable fluid operated rescue tool as set forth in claim 7 the further improvement wherein said surfaces intersect along a transverse line of intersection defining a relatively sharp edge at said outer end.

9. In a portable fluid operated rescue tool as set forth in either claim 6 or claim 7 the further improvement wherein said spreader plate member includes means for effecting gripping engagement with an associated surface.

10. In a portable fluid operated rescue tool as set forth in claim 9 the further improvement wherein said means for effecting gripping engagement comprises a plurality of teeth projecting from said spreader plate member.

11. In a portable fluid operated rescue tool as set forth in either claim 6 or claim 7 the further improvement wherein said spreader plate member has a generally concave laterally outwardly opening contour.

12. A spreader plate assembly for a portable fluid operated rescue tool having a body assembly including a pair of longitudinally elongated force arms pivotally supported at the inner ends thereof on the body assembly for movement between retracted and spread positions, the arms being generally adjacent to each other in the retracted position and the outer ends of the arms being in transversely spread apart relation to each other in the spread position, and fluid operated power means for moving the arms between the retracted and spread positions, said spreader plate assembly comprising a support member having a body portion defining a cavity opening through its inner end for receiving an associated outer end portion of one of the arms therein and shaped to substantially complement said associated outer end portion, means for releasably retaining said support member in connected engagement with said one arm with said outer end portion received in complementary engagement with said support member within said cavity and including a pair of laterally spaced apart side portions integrally connected to said body portion and extending longitudinally inwardly therefrom for receiving a portion of the one arm therebetween, said side portions having laterally aligned pin receiving apertures therethrough, and a retaining pin adapted to extend through said apertures and said one arm, said support member having a transversely outwardly extending integral boss thereon spaced longitudinally inwardly from the outer end of said cavity, a spreader plate having a transversely outwardly facing surface and a pair of laterally spaced apart transversely inwardly extending ears receiving said mounting boss therebetween, and a pivot pin extending through said ears and said mounting boss and supporting said spreader plate for pivotal movement about an axis extending in a lateral direction and spaced transversely outwardly beyond said cavity and longitudinally inwardly beyond the outer end of said cavity.

* * * * *